US008308445B2

(12) United States Patent
Gammack et al.

(10) Patent No.: US 8,308,445 B2
(45) Date of Patent: Nov. 13, 2012

(54) FAN

(75) Inventors: Peter David Gammack, Malmesbury (GB); Frederic Nicolas, Malmesbury (GB); Kevin John Simmonds, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 411 days.

(21) Appl. No.: 12/203,698

(22) Filed: Sep. 3, 2008

(65) Prior Publication Data

US 2009/0060710 A1 Mar. 5, 2009

(30) Foreign Application Priority Data

| | | |
|---|---|---|
| Sep. 4, 2007 | (GB) | 0717148.1 |
| Sep. 4, 2007 | (GB) | 0717151.5 |
| Sep. 4, 2007 | (GB) | 0717154.9 |
| Sep. 4, 2007 | (GB) | 0717155.6 |
| Aug. 14, 2008 | (GB) | 0814835.5 |

(51) Int. Cl.

| | |
|---|---|
| ***F04F 5/46*** | (2006.01) |
| ***B05B 7/04*** | (2006.01) |
| ***B05B 1/06*** | (2006.01) |

(52) U.S. Cl. ..... 417/177; 239/434.5; 239/568

(58) Field of Classification Search ..... 239/265.17, 239/434.5, 561, 568, DIG. 7; 417/76, 84, 417/155, 177, 198

See application file for complete search history.

(56) References Cited

U.S. PATENT DOCUMENTS

| | | | |
|---|---|---|---|
| 1,767,060 | A | 6/1930 | Ferguson |
| 1,896,869 | A | 2/1933 | Larsh |
| 2,014,185 | A | 9/1935 | Martin |
| D103,476 | S | 3/1937 | Weber |
| 2,115,883 | A | 5/1938 | Sher |

(Continued)

FOREIGN PATENT DOCUMENTS

| | | |
|---|---|---|
| BE | 560119 | 8/1957 |

(Continued)

OTHER PUBLICATIONS

GB Search Report directed to counterpart application GB0717151.5 mailed on Dec. 17, 2007; (2 pages).

(Continued)

*Primary Examiner* — Devon Kramer
*Assistant Examiner* — Bryan Lettman
(74) *Attorney, Agent, or Firm* — Morrison & Foerster LLP

(57) ABSTRACT

A fan assembly for creating an air current includes a bladeless fan assembly including a nozzle and a device for creating an air flow through the nozzle. The nozzle includes an interior passage and a mouth receiving the air flow from the interior passage. A Coanda surface located adjacent the mouth and over which the mouth is arranged to direct the air flow. The fan provides an arrangement producing an air current and a flow of cooling air created without requiring a bladed fan, that is, the air flow is created by a bladeless fan.

18 Claims, 5 Drawing Sheets

U.S. PATENT DOCUMENTS

| | | | | |
|---|---|---|---|---|
| D115,344 | S | 6/1939 | Chapman | |
| 2,210,458 | A | 8/1940 | Keiholtz | |
| 2,336,295 | A | 12/1943 | Reimuller | |
| 2,433,795 | A | 12/1947 | Stokes | |
| 2,473,325 | A | 6/1949 | Aufiero | |
| 2,476,002 | A | 7/1949 | Stalker | |
| 2,488,467 | A | 11/1949 | De Lisio | |
| 2,510,132 | A | 6/1950 | Morrison | |
| 2,544,379 | A | 3/1951 | Davenport | |
| 2,547,448 | A | 4/1951 | Demuth | |
| 2,583,374 | A | 1/1952 | Hoffman | |
| 2,620,127 | A | 12/1952 | Radcliffe | |
| 2,808,198 | A | 10/1957 | Morrison | |
| 2,830,779 | A | 4/1958 | Wentling | |
| 2,838,229 | A | 6/1958 | Belanger | |
| 2,922,570 | A | 1/1960 | Allen | |
| 3,047,208 | A | 7/1962 | Coanda | |
| 3,270,655 | A | 9/1966 | Guirl et al. | |
| D206,973 | S | 2/1967 | De Lisio | |
| 3,503,138 | A | 3/1970 | Fuchs et al. | |
| 3,724,092 | A | 4/1973 | McCleerey | |
| 3,743,186 | A | 7/1973 | Mocarski | |
| 3,795,367 | A | 3/1974 | Mocarski | |
| 3,875,745 | A | 4/1975 | Franklin | |
| 3,885,891 | A | 5/1975 | Throndson | |
| 4,037,991 | A | 7/1977 | Taylor | |
| 4,046,492 | A | 9/1977 | Inglis | |
| 4,073,613 | A | 2/1978 | Desty | |
| 4,192,461 | A | 3/1980 | Arborg | |
| 4,336,017 | A | 6/1982 | Desty | |
| 4,342,204 | A | 8/1982 | Melikian et al. | |
| 4,448,354 | A | 5/1984 | Reznick et al. | |
| 4,643,351 | A | 2/1987 | Fukamachi et al. | |
| 4,718,870 | A * | 1/1988 | Watts | 440/47 |
| 4,732,539 | A | 3/1988 | Shin-Chin | |
| 5,061,405 | A | 10/1991 | Stanek et al. | |
| 5,168,722 | A | 12/1992 | Brock | |
| 5,188,508 | A | 2/1993 | Scott et al. | |
| 5,402,938 | A | 4/1995 | Sweeney | |
| 5,425,902 | A | 6/1995 | Miller et al. | |
| 5,609,473 | A | 3/1997 | Litvin | |
| 5,735,683 | A | 4/1998 | Muschelknautz | |
| 5,762,034 | A | 6/1998 | Foss | |
| 5,881,685 | A | 3/1999 | Foss et al. | |
| D415,271 | S | 10/1999 | Feer | |
| 6,015,274 | A | 1/2000 | Bias et al. | |
| 6,073,881 | A | 6/2000 | Chen | |
| D429,808 | S | 8/2000 | Krauss et al. | |
| 6,123,618 | A | 9/2000 | Day | |
| D435,899 | S | 1/2001 | Melwani | |
| 6,254,337 | B1 | 7/2001 | Arnold | |
| 6,269,549 | B1 | 8/2001 | Carlucci et al. | |
| 6,282,746 | B1 | 9/2001 | Schleeter | |
| 6,293,121 | B1 | 9/2001 | Labrador | |
| 6,386,845 | B1 | 5/2002 | Bedard | |
| 6,480,672 | B1 | 11/2002 | Rosenzweig et al. | |
| D485,895 | S | 1/2004 | Melwani | |
| 7,147,336 | B1 | 12/2006 | Chou | |
| D539,414 | S | 3/2007 | Russak et al. | |
| D598,532 | S | 8/2009 | Dyson et al. | |
| D602,143 | S | 10/2009 | Gammack et al. | |
| D602,144 | S | 10/2009 | Dyson et al. | |
| D605,748 | S | 12/2009 | Gammack et al. | |
| 7,664,377 | B2 * | 2/2010 | Liao | 388/851 |
| D614,280 | S | 4/2010 | Dyson et al. | |
| 2003/0059307 | A1 | 3/2003 | Moreno et al. | |
| 2003/0171093 | A1 | 9/2003 | Gumucio Del Pozo | |
| 2004/0022631 | A1 | 2/2004 | Birdsell et al. | |
| 2004/0049842 | A1 | 3/2004 | Prehodka | |
| 2004/0149881 | A1 | 8/2004 | Allen | |
| 2005/0031448 | A1 | 2/2005 | Lasko et al. | |
| 2005/0053465 | A1 | 3/2005 | Roach et al. | |
| 2006/0199515 | A1 | 9/2006 | Lasko et al. | |
| 2007/0166160 | A1 | 7/2007 | Russak et al. | |
| 2008/0166224 | A1 | 7/2008 | Giffin | |
| 2008/0286130 | A1 * | 11/2008 | Purvines | 417/410.1 |
| 2009/0026850 | A1 | 1/2009 | Fu | |
| 2009/0039805 | A1 | 2/2009 | Tang | |
| 2009/0060711 | A1 | 3/2009 | Gammack et al. | |
| 2009/0214341 | A1 | 8/2009 | Craig | |
| 2010/0150699 | A1 | 6/2010 | Nicolas | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton | |

FOREIGN PATENT DOCUMENTS

| | | | |
|---|---|---|---|
| CH | 346643 | | 5/1960 |
| CN | 2111392 | | 7/1992 |
| CN | 201349269 | | 11/2009 |
| DE | 1291090 | | 3/1969 |
| DE | 24 51 557 | | 5/1976 |
| DE | 27 48 724 | | 5/1978 |
| DE | 3644567 | | 7/1988 |
| DE | 19510397 | | 3/1995 |
| EP | 1 138 954 | | 10/2001 |
| EP | 1 939 456 | | 7/2008 |
| EP | 1 980 432 | | 10/2008 |
| EP | 2 000 675 | | 12/2008 |
| FR | 1033034 | | 7/1953 |
| FR | 1119439 | | 6/1956 |
| FR | 2794195 | | 12/2000 |
| GB | 22235 | | 0/1914 |
| GB | 383498 | | 11/1932 |
| GB | 593828 | | 10/1947 |
| GB | 633273 | | 12/1949 |
| GB | 641622 | | 8/1950 |
| GB | 661747 | | 11/1951 |
| GB | 863 124 | | 3/1961 |
| GB | 1067956 | | 5/1967 |
| GB | 1262131 | | 2/1972 |
| GB | 1265341 | | 3/1972 |
| GB | 1 278 606 | | 6/1972 |
| GB | 1 304 560 | | 1/1973 |
| GB | 1 403 188 | | 8/1975 |
| GB | 1 434 226 | | 5/1976 |
| GB | 1501473 | | 2/1978 |
| GB | 2 111 125 | | 6/1983 |
| GB | 2 178 256 | | 2/1987 |
| GB | 2 185 533 | | 7/1987 |
| GB | 2185531 | | 7/1987 |
| GB | 2 218 196 | | 11/1989 |
| GB | 2236804 | | 4/1991 |
| GB | 2242935 | | 10/1991 |
| GB | 2 285 504 | | 7/1995 |
| GB | 2185533 | * | 7/1997 |
| GB | 2 428 569 | | 2/2007 |
| GB | 2 452 593 | | 3/2009 |
| GB | 2452490 | | 3/2009 |
| JP | 56-167897 | | 5/1980 |
| JP | 57-157097 | | 9/1982 |
| JP | 61-31830 | | 2/1986 |
| JP | 61-116093 | | 6/1986 |
| JP | 63-179198 | | 7/1988 |
| JP | 64-21300 U | | 2/1989 |
| JP | 1-138399 | | 5/1989 |
| JP | 2-218890 | | 8/1990 |
| JP | 4-43895 | | 2/1992 |
| JP | 4-366330 | | 12/1992 |
| JP | 5-157093 | | 6/1993 |
| JP | 5-263786 | | 10/1993 |
| JP | 6-74190 | | 3/1994 |
| JP | 6-147188 | | 5/1994 |
| JP | 6-257591 | | 9/1994 |
| JP | 7-190443 | | 7/1995 |

| | | |
|---|---|---|
| JP | 9-100800 | 4/1997 |
| JP | 2000-116179 | 4/2000 |
| JP | 2001-17358 | 1/2001 |
| JP | 2004-216221 | 8/2004 |
| JP | 2005-307985 | 11/2005 |
| JP | 2007-138763 | 6/2007 |
| JP | 2007-138789 | 6/2007 |
| JP | 2008-100204 | 5/2008 |
| JP | 2009-44568 | 2/2009 |
| WO | WO 90/13478 | 11/1990 |
| WO | WO-02/073096 | 9/2002 |
| WO | WO 03/058795 | 7/2003 |
| WO | WO-2005/050026 | 6/2005 |
| WO | WO 2005/057091 | 6/2005 |
| WO | WO 2007/024955 | 3/2007 |
| WO | WO 2007/048205 | 5/2007 |
| WO | WO 2008/014641 | 2/2008 |
| WO | WO-2008/024569 | 2/2008 |
| WO | WO-2009/030879 | 3/2009 |
| WO | WO-2009/030881 | 3/2009 |

OTHER PUBLICATIONS

GB Search Report directed to counterpart application GB0717155.6 mailed on Dec. 19, 2007; (2 pages).

GB Search Report directed to counterpart application GB0717154.9 mailed on Dec. 17, 2007; (2 pages).

GB Search Report directed to counterpart application GB0717148.1 mailed on Dec. 20, 2007; (1 page).

International Search Report and Written Opinion mailed Oct. 29, 2008, directed to counterpart International Patent Application No. PCT/GB2008/002891; (11 pages).

International Search Report and Written Opinion mailed Oct. 31, 2008, directed to counterpart International Patent Application No. PCT/GB2008/002874; (9 pages).

Gammack et al., U.S. Office Action mailed Jun. 15, 2009, directed to Design U.S. Appl. No. 29/328,939; (5 pages).

Dyson, J., et al., "Fan" Design U.S. Appl. No. 29/336,687, filed May 7, 2009; 6 pages.

Reba, I., (Jun. 1966). "Applications of the Coanda Effect." *Scientific American*.214:84-92.

Gammack et al., U.S. Appl. No. 12/945,558, filed Nov. 12, 2010; 23 pages.

Gammack et al., U.S. Office Action mailed Dec. 10, 2010, directed to related U.S. Appl. No. 12/230,613; 12 pages.

Simmonds, K. J. et al. U.S. Appl. No. 13/125,742, filed Apr. 22, 2011; 20 pages.

Nicolas, F. et al., U.S. Office Action mailed Mar. 7, 2011, directed to U.S. Appl. No. 12/622,844; 10 pages.

Fitton, N.G. et al., U.S. Office Action mailed Mar. 8, 2011, directed to U.S. Appl. No. 12/716,780; 12 pages.

Gammack et al., U.S. Appl. No. 12/917,247, filed Nov. 1, 2010; 40 pages.

Fitton et al., U.S. Office Action mailed Nov. 30, 2010 directed to U.S. Appl. No. 12/560,232; 9 pages.

Gammack, P. et al., U.S. Office Action mailed Dec. 9, 2010, directed to U.S. Appl. No. 12/716,781; 17 pages.

Gammack, P. et al., U.S. Office Action mailed Jun. 24, 2011, directed to U.S. Appl. No. 12/716,781; 19 pages.

Gammack, P. et al. U.S. Office Action mailed May 13, 2011, directed to U.S. Appl. No. 12/230,613; 13 pages.

Third Party Submission Under 37 CFR 1.99 filed Jun. 2, 2011, directed towards U.S. Appl. No. 12/203,698; 3 pages.

* cited by examiner

FAN

REFERENCE TO RELATED APPLICATIONS

This application claims the priority of United Kingdom Application Nos. 0717155.6, 0717148.1, 0717151.5 and 0717154.9, all filed Sep. 4, 2007, and No. 0814835.5 filed on Aug. 14, 2008, the contents of which prior applications are incorporated herein by reference.

FIELD OF THE INVENTION

The present invention relates to a fan appliance. Particularly, but not exclusively, the present invention relates to a domestic fan, such as a desk fan, for creating air circulation and air current in a room, in an office or other domestic environment.

BACKGROUND OF THE INVENTION

A number of types of domestic fan are known. It is common for a conventional fan to include a single set of blades or vanes mounted for rotation about an axis, and driving apparatus mounted about the axis for rotating the set of blades. Domestic fans are available in a variety of sizes and diameters, for example, a ceiling fan can be at least 1 m in diameter and is usually mounted in a suspended manner from the ceiling and positioned to provide a downward flow of air and cooling throughout a room.

Desk fans, on the other hand, are often around 30 cm in diameter and are usually free standing and portable. In standard desk fan arrangements the single set of blades is positioned close to the user and the rotation of the fan blades provides a forward flow of air current in a room or into a part of a room, and towards the user. Other types of fan can be attached to the floor or mounted on a wall. The movement and circulation of the air creates a so called 'wind chill' or breeze and, as a result, the user experiences a cooling effect as heat is dissipated through convection and evaporation. Fans such as that disclosed in USD 103,476 are suitable for standing on a desk or a table. U.S. Pat. No. 2,620,127 discloses a dual purpose fan suitable for use either mounted in a window or as a portable desk fan.

In a domestic environment it is desirable for appliances to be as small and compact as possible. U.S. Pat. No. 1,767,060 describes a desk fan with an oscillating function that aims to provide an air circulation equivalent to two or more prior art fans. In a domestic environment it is undesirable for parts to project from the appliance, or for the user to be able to touch any moving parts of the fan, such as the blades. USD 103,476 includes a cage around the blades. Other types of fan or circulator are described in U.S. Pat. No. 2,488,467, U.S. Pat. No. 2,433,795 and JP 56-167897. The fan of U.S. Pat. No. 2,433,795 has spiral slots in a rotating shroud instead of fan blades.

Some of the above prior art arrangements have safety features such as a cage or shroud around the blades to protect a user from injuring himself on the moving parts of the fan. However, caged blade parts can be difficult to clean and the movement of blades through air can be noisy and disruptive in a home or office environment.

A disadvantage of certain of the prior art arrangements is that the air flow produced by the fan is not felt uniformly by the user due to variations across the blade surface or across the outward facing surface of the fan. Uneven or 'choppy' air flow can be felt as a series of pulses or blasts of air. A further disadvantage is that the cooling effect created by the fan diminishes with distance from the user. This means the fan must be placed in close proximity to the user in order for the user to receive the benefit of the fan.

Locating fans such as those described above close to a user is not always possible as the bulky shape and structure mean that the fan occupies a significant amount of the user's work space area. In the particular case of a fan placed on, or close to, a desk the fan body reduces the area available for paperwork, a computer or other office equipment.

The shape and structure of a fan at a desk not only reduces the working area available to a user but can block natural light (or light from artificial sources) from reaching the desk area. A well lit desk area is desirable for close work and for reading. In addition, a well lit area can reduce eye strain and the related health problems that may result from prolonged periods working in reduced light levels.

SUMMARY OF THE INVENTION

The present invention seeks to provide an improved fan assembly which obviates disadvantages of the prior art. It is an object of the present invention to provide a fan assembly which, in use, generates air flow at an even rate over the emission output area of the fan. It is another object to provide an improved fan assembly whereby a user at a distance from the fan feels an improved air flow and cooling effect in comparison to prior art fans.

According to the invention, there is provided a bladeless fan assembly for creating an air current, the fan assembly comprising a nozzle and means for creating an air flow through the nozzle, the nozzle comprising an interior passage, a mouth for receiving the air flow from the interior passage, and a Coanda surface located adjacent the mouth and over which the mouth is arranged to direct the air flow.

Advantageously, by this arrangement an air current is generated and a cooling effect is created without requiring a bladed fan. The bladeless arrangement leads to lower noise emissions due to the absence of the sound of a fan blade moving through the air, and a reduction in moving parts and complexity.

In the following description of fans and, in particular a fan of the preferred embodiment, the term 'bladeless' is used to describe apparatus in which air flow is emitted or projected forwards from the fan assembly without the use of blades. By this definition a bladeless fan assembly can be considered to have an output area or emission zone absent blades or vanes from which the air flow is released or emitted in a direction appropriate for the user. A bladeless fan assembly may be supplied with a primary source of air from a variety of sources or generating means such as pumps, generators, motors or other fluid transfer devices, which include rotating devices such as a motor rotor and a bladed impeller for generating air flow. The supply of air generated by the motor causes a flow of air to pass from the room space or environment outside the fan assembly through the interior passage to the nozzle and then out through the mouth.

Hence, the description of a fan assembly as bladeless is not intended to extend to the description of the power source and components such as motors that are required for secondary fan functions. Examples of secondary fan functions can include lighting, adjustment and oscillation of the fan.

The bladeless fan assembly achieves the output and cooling effect described above with a nozzle which includes a Coanda surface to provide an amplifying region utilising the Coanda effect. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment whereby a primary air flow is directed over the Coanda surface. A description of the features of a Coanda surface, and the effect of fluid flow over a Coanda surface, can be found in articles such as Reba, Scientific American, Volume 214, June 1963 pages 84 to 92.

Preferably the nozzle defines an opening through which air from outside the fan assembly is drawn by the air flow directed over the Coanda surface. Air from the external environment is drawn through the opening by the air flow directed over the Coanda surface. Advantageously, by this arrangement the assembly can be produced and manufactured with a reduced number of parts than those required in prior art fans. This reduces manufacturing cost and complexity.

In the present invention an air flow is created through the nozzle of the fan assembly. In the following description this air flow will be referred to as primary air flow. The primary air flow exits the nozzle via the mouth and passes over the Coanda surface. The primary air flow entrains the air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly. The primary air flow directed over the Coanda surface combined with the secondary air flow entrained by the air amplifier gives a total air flow emitted or projected forward to a user from the opening defined by the nozzle. The total air flow is sufficient for the fan assembly to create an air current suitable for cooling.

The air current delivered by the fan assembly to the user has the benefit of being an air flow with low turbulence and with a more linear air flow profile than that provided by other prior art devices. Linear air flow with low turbulence travels efficiently out from the point of emission and loses less energy and less velocity to turbulence than the air flow generated by prior art fans. An advantage for a user is that the cooling effect can be felt even at a distance and the overall efficiency of the fan increases. This means that the user can choose to site the fan some distance from a work area or desk and still be able to feel the cooling benefit of the fan.

Advantageously, the assembly results in the entrainment of air surrounding the mouth of the nozzle such that the primary air flow is amplified by at least 15%, whilst a smooth overall output is maintained. The entrainment and amplification features of the fan assembly result in a fan with a higher efficiency than prior art devices. The air current emitted from the opening defined by the nozzle has an approximately flat velocity profile across the diameter of the nozzle. Overall the flow rate and profile can be described as plug flow with some regions having a laminar or partial laminar flow.

Preferably the nozzle comprises a loop. The shape of the nozzle is not constrained by the requirement to include space for a bladed fan. In a preferred embodiment the nozzle is annular. By providing an annular nozzle the fan can potentially reach a broad area. In a further preferred embodiment the nozzle is at least partially circular. This arrangement can provide a variety of design options for the fan, increasing the choice available to a user or customer.

Preferably, the interior passage is continuous. This allows smooth, unimpeded air flow within the nozzle and reduces frictional losses and noise. In this arrangement the nozzle can be manufactured as a single piece, reducing the complexity of the fan assembly and thereby reducing manufacturing costs.

It is preferred that the mouth is substantially annular. By providing a substantially annular mouth the total air flow can be emitted towards a user over a broad area. Advantageously, an illumination source in the room or at the desk fan location or natural light can reach the user through the central opening.

Preferably, the mouth is concentric with the interior passage. This arrangement will be visually appealing and the concentric location of the mouth with the passage facilitates manufacture. Preferably, the Coanda surface extends symmetrically about an axis. More preferably, the angle subtended between the Coanda surface and the axis is in the range from 7° to 20°, preferably around 15°. This provides an efficient primary air flow over the Coanda surface and leads to maximum air entrainment and secondary air flow.

Preferably the nozzle extends by a distance of at least 5 cm in the direction of the axis. Preferably the nozzle extends about the axis in the shape of a loop and preferably by a distance in the range from 30 cm to 180 cm. This provides options for emission of air over a range of different output areas and opening sizes, such as may be suitable for cooling the upper body and face of a user when working at a desk, for example. In the preferred embodiment the nozzle comprises a diffuser located downstream of the Coanda surface. An angular arrangement of the diffuser surface and an aerofoil-type shaping of the nozzle and diffuser surface can enhance the amplification properties of the fan assembly whilst minimising noise and frictional losses.

In a preferred arrangement the nozzle comprises at least one wall defining the interior passage and the mouth, and the at least one wall comprises opposing surfaces defining the mouth. Preferably, the mouth has an outlet, and the spacing between the opposing surfaces at the outlet of the mouth is in the range from 1 mm to 5 mm, more preferably around 1.3 mm. By this arrangement a nozzle can be provided with the desired flow properties to guide the primary air flow over the Coanda surface and provide a relatively uniform, or close to uniform, total air flow reaching the user.

In the preferred fan arrangement the means for creating an air flow through the nozzle comprises an impeller driven by a motor. This arrangement provides a fan with efficient air flow generation. More preferably the means for creating an air flow comprises a DC brushless motor and a mixed flow impeller. This arrangement reduces frictional losses from motor brushes and also reduces carbon debris from the brushes in a traditional motor. Reducing carbon debris and emissions is advantageous in a clean or pollutant sensitive environment such as a hospital or around those with allergies.

The nozzle may be rotatable or pivotable relative to a base portion, or other portion, of the fan assembly. This enables the nozzle to be directed towards or away from a user as required. The fan assembly may be desk, floor, wall or ceiling mountable. This can increase the portion of a room over which the user experiences cooling.

BRIEF DESCRIPTION OF THE DRAWINGS

An embodiment of the invention will now be described with reference to the accompanying drawings, in which.

DETAILED DESCRIPTION OF THE INVENTION

Figure 1:
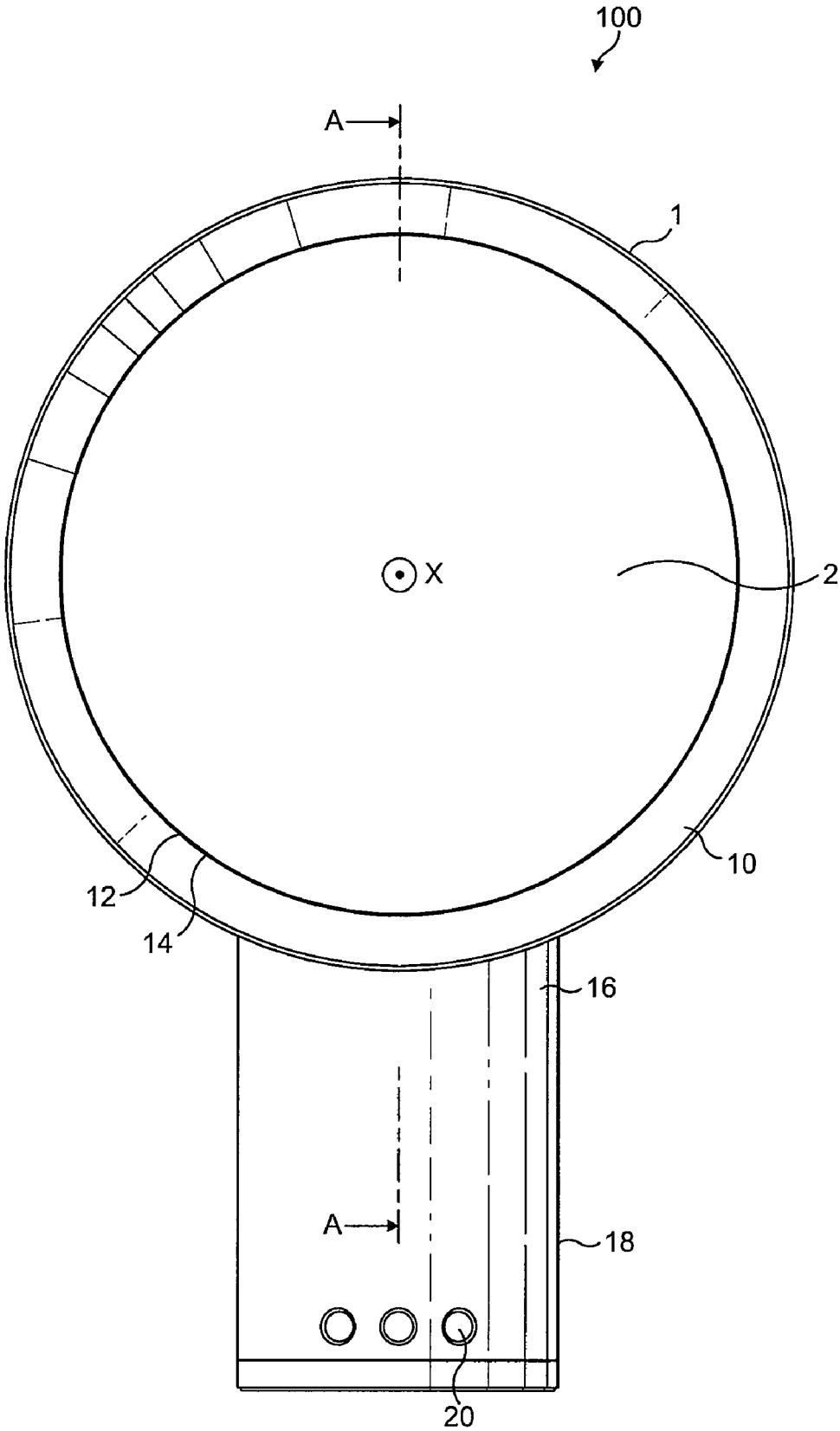
FIG. 1 is a front view of a fan assembly.
Figure 2:
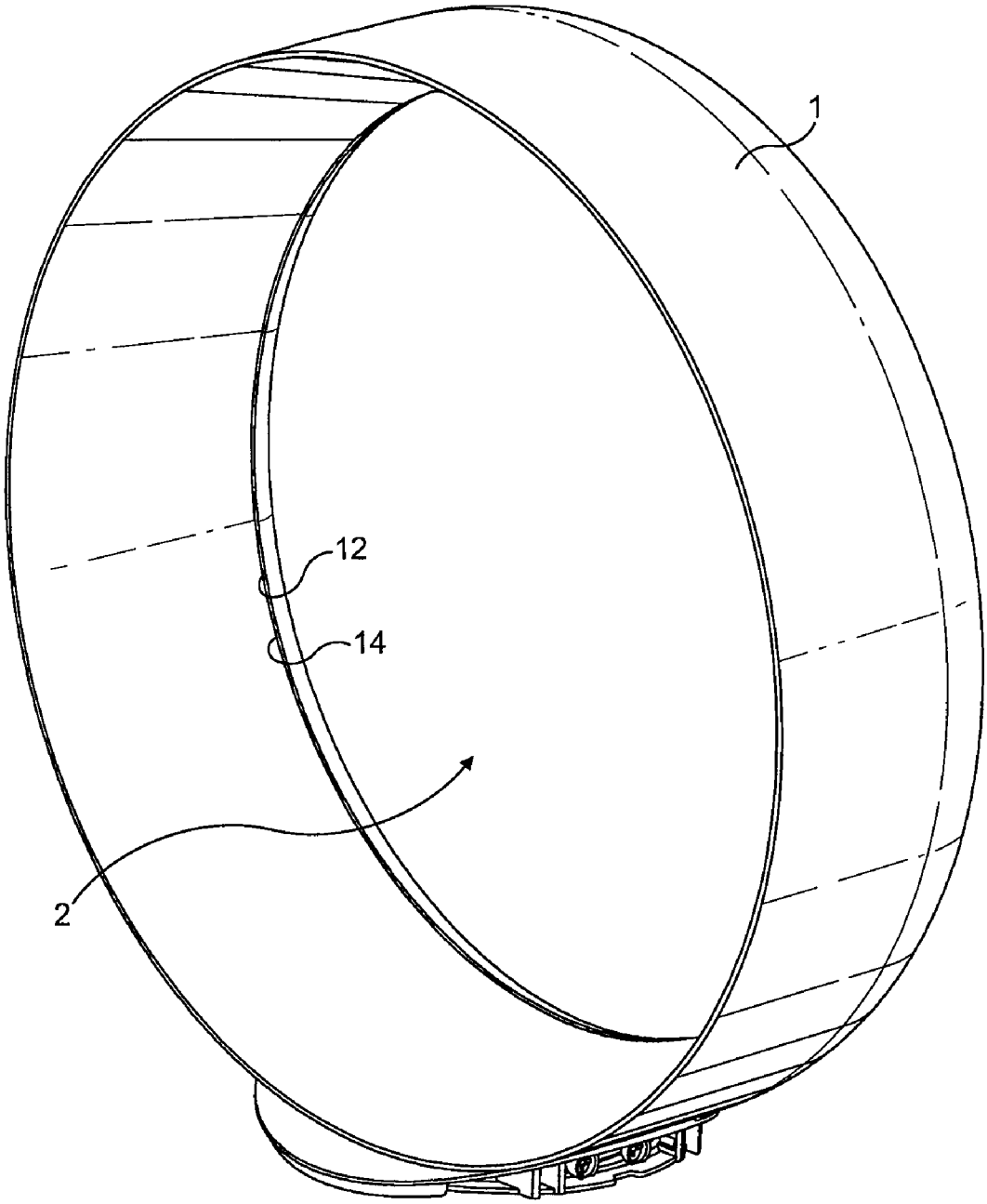
FIG. 2 is a perspective view of a portion of the fan assembly of FIG. 1.
Figure 3:
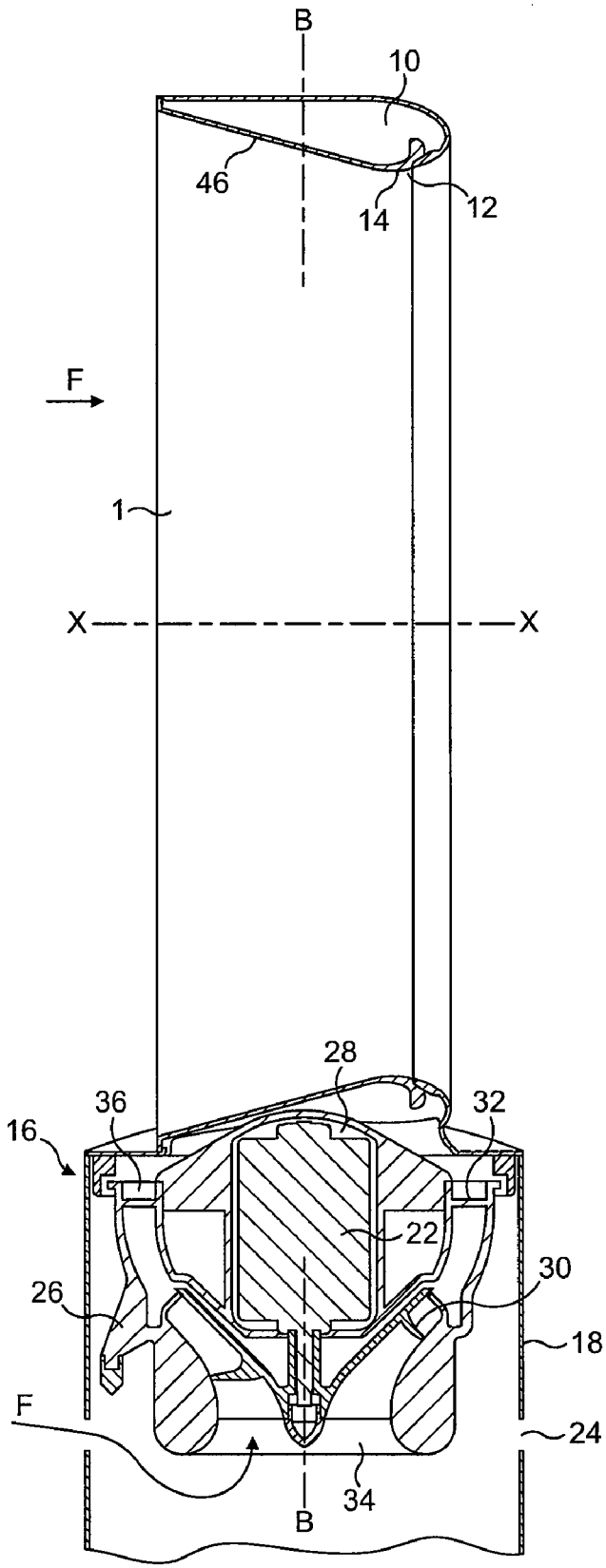
FIG. 3 is a side sectional view through a portion of the fan assembly of FIG. 1 taken at line A-A.

FIG. 1 shows an example of a fan assembly 100 viewed from the front of the device. The fan assembly 100 comprises an annular nozzle 1 defining a central opening 2. With reference also to FIGS. 2 and 3, nozzle 1 comprises an interior passage 10, a mouth 12 and a Coanda surface 14 adjacent the mouth 12. The Coanda surface 14 is arranged so that a primary air flow exiting the mouth 12 and directed over the Coanda surface 14 is amplified by the Coanda effect. The nozzle 1 is connected to, and supported by, a base 16 having an outer casing 18. The base 16 includes a plurality of selection buttons 20 accessible through the outer casing 18 and through which the fan assembly 100 can be operated.

Figure 4:
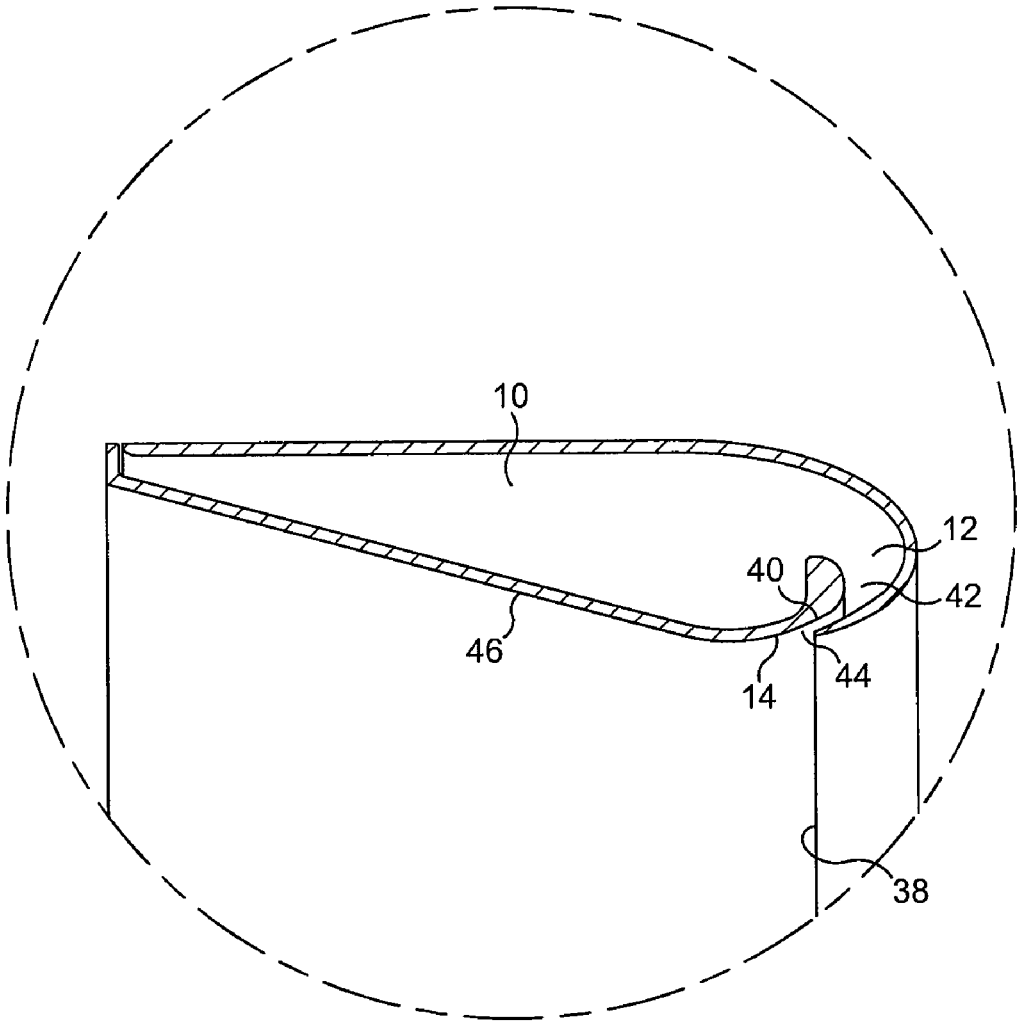
FIG. 4 is an enlarged side sectional detail of a portion of the fan assembly of FIG. 1.
Figure 5:
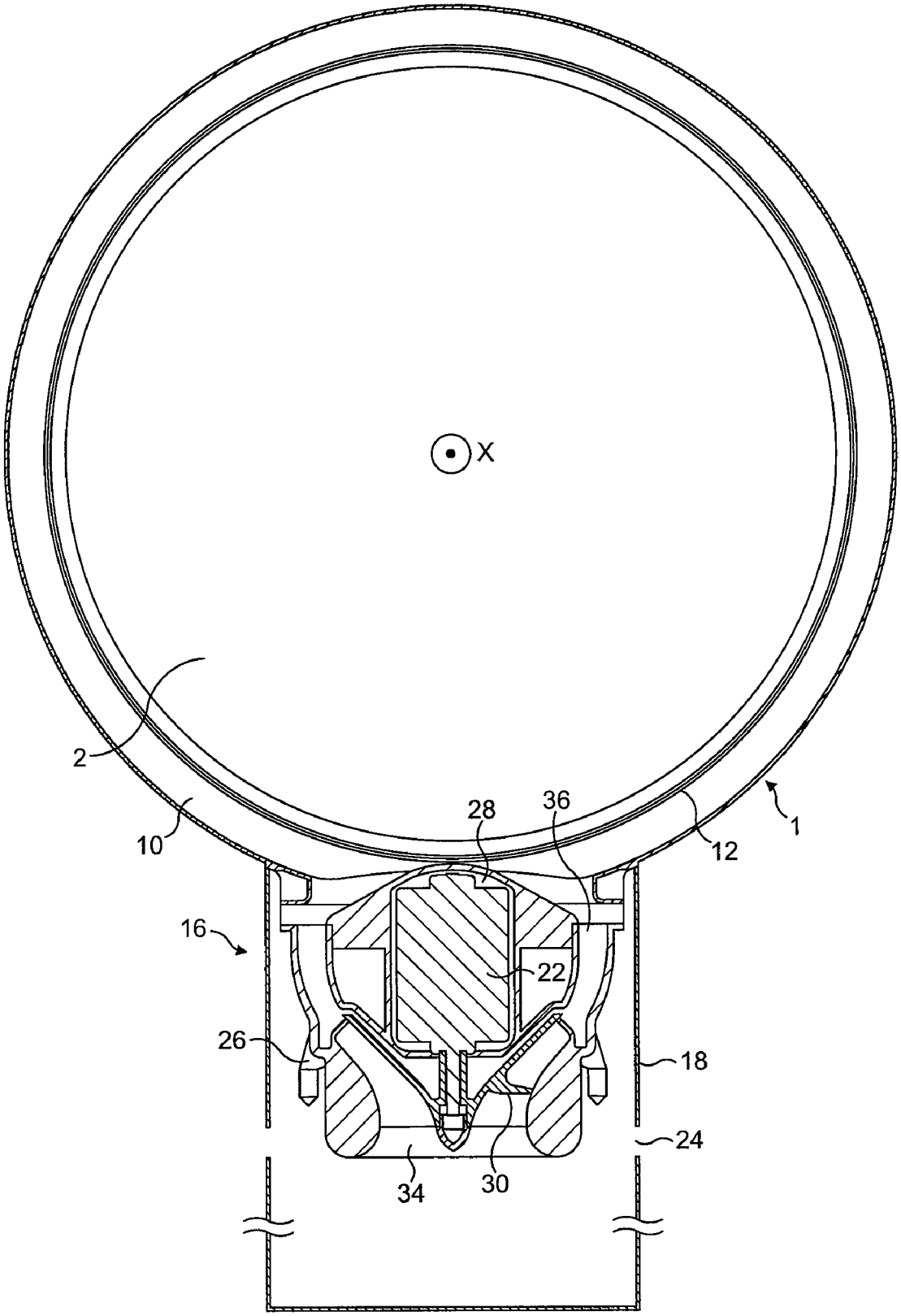
FIG. 5 is a sectional view of the fan assembly taken along line B-B of FIG. 3 and viewed from direction F of FIG. 3.

FIGS. 3, 4 and 5 show further specific details of the fan assembly 100. A motor 22 for creating an air flow through the nozzle 1 is located inside the base 16. The base 16 further comprises an air inlet 24 formed in the outer casing 18. A motor housing 26 is located inside the base 16. The motor 22 is supported by the motor housing 26 and held in a secure position by a rubber mount or seal member 28.

In the illustrated embodiment, the motor 22 is a DC brushless motor. An impeller 30 is connected to a rotary shaft extending outwardly from the motor 22, and a diffuser 32 is positioned downstream of the impeller 30. The diffuser 32 comprises a fixed, stationary disc having spiral blades.

An inlet 34 to the impeller 30 communicates with the air inlet 24 formed in the outer casing 18 of the base 16. The outlet 36 of the diffuser 32 and the exhaust from the impeller 30 communicate with hollow passageway portions or ducts located inside the base 16 in order to establish air flow from the impeller 30 to the interior passage 10 of the nozzle 1. The motor 22 is connected to an electrical connection and power supply and is controlled by a controller (not shown). Communication between the controller and the plurality of selection buttons 20 enable a user to operate the fan assembly 100.

The features of the nozzle 1 will now be described with reference to FIGS. 3 and 4. The shape of the nozzle 1 is annular. In this embodiment the nozzle 1 has a diameter of around 350 mm, but the nozzle may have any desired diameter, for example around 300 mm. The interior passage 10 is annular and is formed as a continuous loop or duct within the nozzle 1. The nozzle 1 is formed from at least one wall defining the interior passage 10 and the mouth 12. In this embodiment the nozzle 1 comprises an inner wall 38 and an outer wall 40. In the illustrated embodiment the walls 38, 40 are arranged in a looped or folded shape such that the inner wall 38 and outer wall 40 approach one another. The inner wall 38 and the outer wall 40 together define the mouth 12, and the mouth 12 extends about the axis X. The mouth 12 comprises a tapered region 42 narrowing to an outlet 44. The outlet 44 comprises a gap or spacing formed between the inner wall 38 of the nozzle 1 and the outer wall 40 of the nozzle 1. The spacing between the opposing surfaces of the walls 38, 40 at the outlet 44 of the mouth 12 is chosen to be in the range from 1 mm to 5 mm. The choice of spacing will depend on the desired performance characteristics of the fan. In this embodiment the outlet 44 is around 1.3 mm wide, and the mouth 12 and the outlet 44 are concentric with the interior passage 10.

The mouth 12 is adjacent the Coanda surface 14. The nozzle 1 further comprises a diffuser portion located downstream of the Coanda surface. The diffuser portion includes a diffuser surface 46 to further assist the flow of air current delivered or output from the fan assembly 100. In the example illustrated in FIG. 3 the mouth 12 and the overall arrangement of the nozzle 1 is such that the angle subtended between the Coanda surface 14 and the axis X is around 15°. The angle is chosen for efficient air flow over the Coanda surface 14. The base 16 and the nozzle 1 have a depth in the direction of the axis X. The nozzle 1 extends by a distance of around 5 cm in the direction of the axis. The diffuser surface 46 and the overall profile of the nozzle 1 are based on an aerofoil shape, and in the example shown the diffuser portion extends by a distance of around two thirds the overall depth of the nozzle 1.

The fan assembly 100 described above operates in the following manner. When a user makes a suitable selection from the plurality of buttons 20 to operate or activate the fan assembly 100, a signal or other communication is sent to drive the motor 22. The motor 22 is thus activated and air is drawn into the fan assembly 100 via the air inlet 24. In the preferred embodiment air is drawn in at a rate of approximately 20 to 30 liters per second, preferably around 27 l/s (liters per second). The air passes through the outer casing 18 and along the route illustrated by arrow F of FIG. 3 to the inlet 34 of the impeller 30. The air flow leaving the outlet 36 of the diffuser 32 and the exhaust of the impeller 30 is divided into two air flows that proceed in opposite directions through the interior passage 10. The air flow is constricted as it enters the mouth 12 and is further constricted at the outlet 44 of the mouth 12. The air flow exits through the outlet 44 as a primary air flow.

The output and emission of the primary air flow creates a low pressure area at the air inlet 24 with the effect of drawing additional air into the fan assembly 100. The operation of the fan assembly 100 induces high air flow through the nozzle 1 and out through the opening 2. The primary air flow is directed over the Coanda surface 14 and the diffuser surface 46, and is amplified by the Coanda effect. A secondary air flow is generated by entrainment of air from the external environment, specifically from the region around the outlet 44 and from around the outer edge of the nozzle 1. A portion of the secondary air flow entrained by the primary air flow may also be guided over the diffuser surface 46. This secondary air flow passes through the opening 2, where it combines with the primary air flow to produce a total air flow projected forward from the fan assembly 100 in the region of 500 to 700 l/s.

The combination of entrainment and amplification results in a total air flow from the opening 2 of the fan assembly 100 that is greater than the air flow output from a fan assembly without such a Coanda or amplification surface adjacent the emission area.

The amplification and laminar type of air flow produced results in a sustained flow of air being directed towards a user from the nozzle 1. The flow rate at a distance of up to 3 nozzle diameters (i.e. around 1000 to 1200 mm) from a user is around 400 to 500 l/s. The total air flow has a velocity of around 3 to 4 m/s (meters per second). Higher velocities are achievable by reducing the angle subtended between the Coanda surface 14 and the axis X. A smaller angle results in the total air flow being emitted in a more focussed and directed manner. This type of air flow tends to be emitted at a higher velocity but with a reduced mass flow rate. Conversely, greater mass flow can be achieved by increasing the angle between the Coanda surface and the axis. In this case the velocity of the emitted air flow is reduced but the mass flow generated increases. Thus the performance of the fan assembly can be altered by altering the angle subtended between the Coanda surface and the axis X.

The invention is not limited to the detailed description given above. Variations will be apparent to the person skilled in the art. For example, the fan could be of a different height or diameter. The fan need not be located on a desk, but could be free standing, wall mounted or ceiling mounted. The fan shape could be adapted to suit any kind of situation or location where a cooling flow of air is desired. A portable fan could have a smaller nozzle, say 5 cm in diameter. The means for creating an air flow through the nozzle can be a motor or other air emitting device, such as any air blower or vacuum source that can be used so that the fan assembly can create an air current in a room. Examples include a motor such as an AC induction motor or types of DC brushless motor, but may also comprise any suitable air movement or air transport device such as a pump or other means of providing directed fluid flow to generate and create an air flow. Features of a motor may include a diffuser or a secondary diffuser located downstream of the motor to recover some of the static pressure lost in the motor housing and through the motor.

The outlet of the mouth may be modified. The outlet of the mouth may be widened or narrowed to a variety of spacings to maximise air flow. The Coanda effect may be made to occur over a number of different surfaces, or a number of internal or external designs may be used in combination to achieve the flow and entrainment required.

Other shapes of nozzle are envisaged. For example, a nozzle comprising an oval, or 'racetrack' shape, a single strip or line, or block shape could be used. The fan assembly provides access to the central part of the fan as there are no blades. This means that additional features such as lighting or a clock or LCD display could be provided in the opening defined by the nozzle.

Other features could include a pivotable or tiltable base for ease of movement and adjustment of the position of the nozzle for the user.

The invention claimed is:

1. A bladeless fan assembly for creating an air current, the fan assembly comprising:

a nozzle, and a device creating an air flow through the nozzle, the nozzle comprising an interior passage, formed between a first wall and a second wall, wherein a distal end of the first wall overlaps a distal end of the second wall to form, near the distal ends of the first and second walls, a mouth for receiving the air flow from the interior passage, a tapered region, located downstream from the mouth, and an outlet, located downstream of the tapered region, for releasing the air flow from the nozzle, wherein a distance between the first wall and the second wall is greater at the mouth than at the outlet, and a Coanda surface located adjacent the outlet, wherein the first wall is curved proximate to its distal end to direct the air flow over the Coanda surface, and wherein a thickness of the first wall decreases near the distal end, and a thickness of the second wall increases near the distal end.

2. The fan assembly as claimed in claim 1, wherein the nozzle defines an opening through which air from outside the fan assembly is drawn by the air flow directed over the Coanda surface.

3. The fan assembly as claimed in claim 1 or 2, wherein the nozzle comprises a loop.

4. The fan assembly as claimed in claim 1 or 2, wherein the nozzle is annular.

5. The fan assembly as claimed in claim 1 or 2, wherein the nozzle is at least partially circular.

6. The fan assembly as claimed in claim 1 or 2, wherein the interior passage is continuous.

7. The fan assembly as claimed in claim 1 or 2, wherein the interior passage is annular.

8. The fan assembly as claimed in claim 1 or 2, wherein the mouth is annular.

9. The fan assembly as claimed in claim 1 or 2, wherein the mouth is concentric with the interior passage.

10. The fan assembly as claimed in claim 1 or 2, wherein the nozzle comprises a diffuser located downstream of the Coanda surface.

11. The fan assembly as claimed in claim 1 or 2, wherein a spacing between the first and second walls at the mouth is in a range from 1 mm to 5 mm.

12. The fan assembly as claimed in claim 1 or 2, wherein the Coanda surface extends symmetrically about an axis.

13. The fan assembly as claimed in claim 12, wherein an angle subtended between the Coanda surface and the axis is in a range from 7° to 20°.

14. The fan assembly as claimed in claim 12, wherein the nozzle extends by a distance of at least 5 cm in the direction of the axis.

15. The fan assembly as claimed in claim 12, wherein the nozzle extends about the axis by a distance in a range from 30 cm to 180 cm.

16. The fan assembly as claimed in claim 12, wherein an angle subtended between the Coanda surface and the axis is 15°.

17. The fan assembly as claimed in claim 1 or 2, wherein the device creating the air flow through the nozzle comprises an impeller driven by a motor.

18. The fan assembly as claimed in claim 17, wherein the device creating the air flow comprises a DC brushless motor and a mixed flow impeller.

* * * * *